US005167279A

United States Patent [19]

Stafford

[11] Patent Number: 5,167,279

[45] Date of Patent: Dec. 1, 1992

[54] WELL CLEANING ASSEMBLY

[76] Inventor: Lawrence R. Stafford, 3905 Starwood, Bakersfield, Calif. 93309

[21] Appl. No.: 809,621

[22] Filed: Dec. 16, 1991

[51] Int. Cl.[5] ..... E21B 37/00

[52] U.S. Cl. ..... 166/171; 166/173

[58] Field of Search ..... 166/171, 55.1, 173, 166/55.3, 123, 311, 66, 312

[56] References Cited

U.S. PATENT DOCUMENTS

| | | | |
|---|---|---|---|
| 206,242 | 7/1878 | Jeannerat | 166/171 |
| 2,151,416 | 3/1939 | Black et al. | 166/171 |
| 2,212,784 | 8/1940 | McCune | 166/171 |
| 2,224,412 | 12/1940 | Smith | 166/171 |
| 2,574,141 | 11/1951 | Brown | 166/171 |
| 2,602,515 | 7/1952 | Baker et al. | 166/173 |
| 4,892,145 | 1/1990 | Stafford | 166/171 |

*Primary Examiner*—Ramon S. Britts
*Assistant Examiner*—Frank S. Tsay
*Attorney, Agent, or Firm*—I. Michael Bak-Boychuk

[57] ABSTRACT

A well cleaning attachment useful as a part of a collection of tools sent down a well bore on a tubing string includes a tubular mandrel provided with a plurality of longitudinal slots in which corresponding knife carriers are inserted. Each carrier is bedded on a leaf spring for radial motion within the slot and each is provided with a spring biased blade extending pivotally to the exterior. Two collars then fix the carriers within the slots, the same collars also engaging the periphery of the mandrel.

4 Claims, 1 Drawing Sheet

WELL CLEANING ASSEMBLY

BACKGROUND OF THE INVENTION

1. Field of the Invention

The present invention relates to well casing perforation cleaning assemblies, and more particularly to a mechanical piercing array useful in opening clogged well perforations.

2. Description of the Prior Art

In my prior U.S. Pat. No. 4,892,145 issued Jan. 9, 1990, I have described a mechanical assembly in which an array of spring loaded blades is used to loosen debris collected in the perforations of a well casing. Since that time I have devised substantial structural simplifications, all having the object and purpose to render the assembly more reliable and convenient in use.

A well bore extending into a subsurface formation typically includes an internal liner formed as a stack of cylindrical casing segments. Such casing segments are either solid or perforated, depending on the strata in the formation from which the well fluids are drawn, thus serving as a selection mechanism for the fluids of interest to the well operator. As this well fluid is withdrawn formation fluids migrate towards the well bore, bringing with them particulate and dissolved matter which eventually collects in the casing perforations. Thus, the casing perforations must be periodically cleaned, with cleaning frequency greatly dependent on the characteristics of the formation.

Effective well cleaning entails both a wash sequence and the mechanical process directed at solid debris. Thus, the mechanical array is passed into the well bore in association with attachments that deliver cleaning fluid at pressure. The complexity of such a combination, along with the cost of personnel, the cost of the manipulative structure, and the remote locations of producing wells, all dictate a rugged mechanism that is easily worked and repaired in the field. It is one such mechanism that is described herein.

SUMMARY OF THE INVENTION

Accordingly, it is the general purpose and object of the present invention to provide a well cleaning assembly conformed for axial attachment to other well cleaning devices.

Other objects of the invention are to provide a mechanical cleaning array comprising a plurality of standardized parts.

Yet further objects of the invention are to provide a well bore cleaning array conformed for convenient repair and replacement.

Briefly, these and other objects are accomplished within the present invention by way of a segment of well string tubing, threaded at both ends, and slotted on the exterior by a plurality of longitudinal slots. A corresponding plurality of rectangular blocks, each of a planform conformed for receipt in the slots formed in the tubing segment, or mandrel, are provided with longitudinal drillings or bores in which helical springs are retained. These springs then oppose the interior ends of pivoted knives projecting to the exterior of each block.

A pair of circular collars then clamp the respective blocks in the slots of the mandrel, compressing each block against a captured spring placed at the slot bottom. Thus, some inward mobility of each block is provided, along with the pivotal mobility of each spring biased blade.

In this manner an array of identical blocks effects a complete assembly, reducing the complement of spares in a conveniently serviced arrangement.

DESCRIPTION OF THE PREFERRED EMBODIMENT

Figure 1:
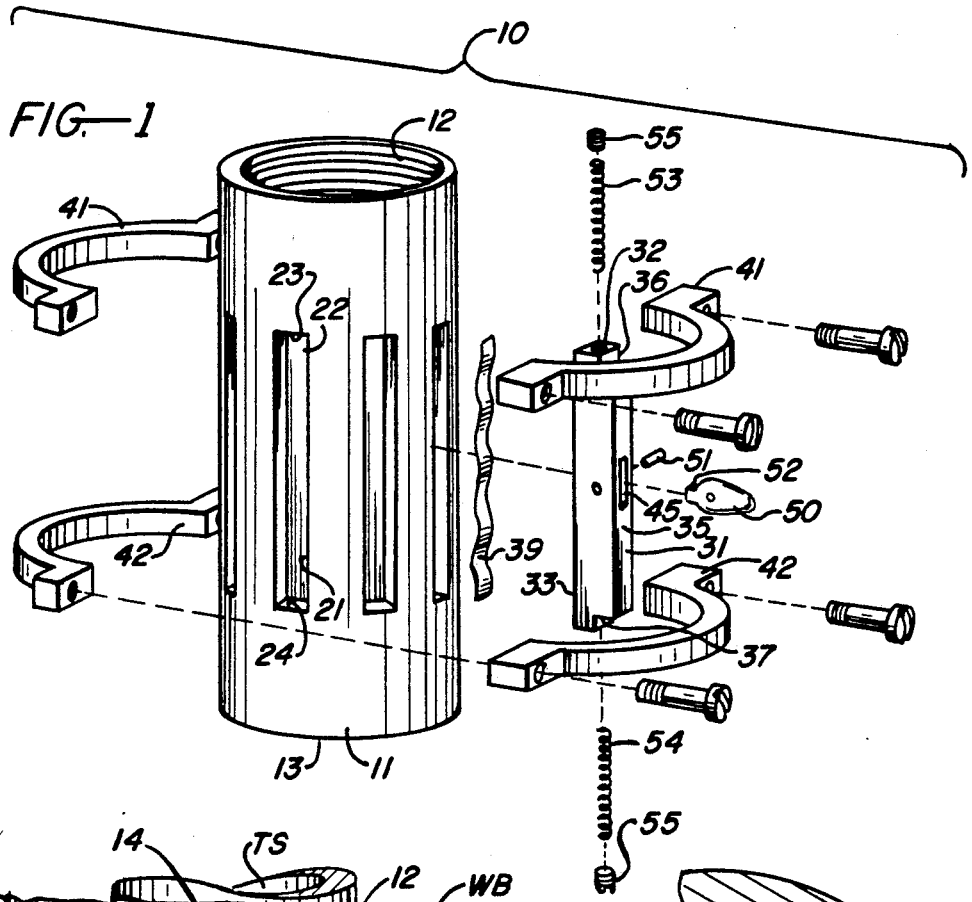
FIG. 1 is a perspective illustration of the inventive cleaning assembly, illustrated in a separation of components.
Figure 2:
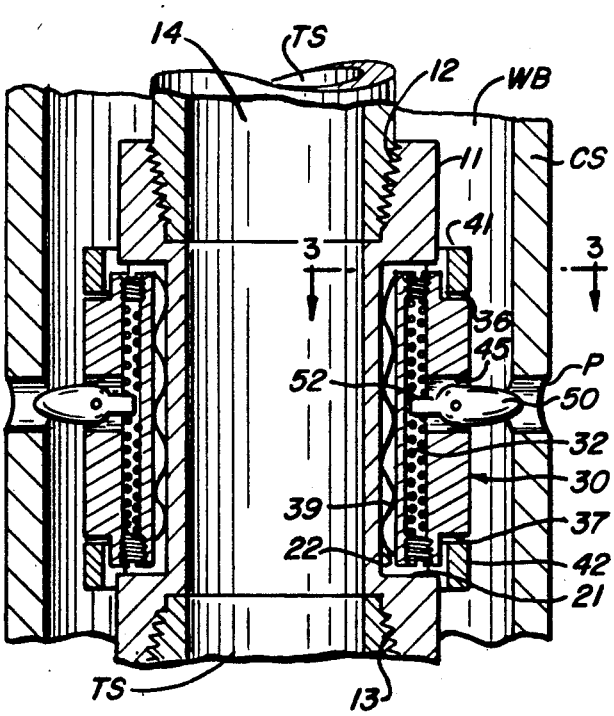
FIG. 2 is a side view, in section, of the assembly shown in FIG. 1.
Figure 3:
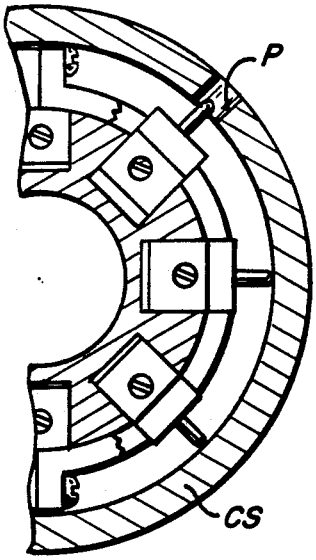
FIG. 3 is a detail view, in partial section, of one replaceable block assembly in accordance with the present invention.

As shown in FIGS. 1–3 the inventive cleaning assembly, generally designated by the numeral 10, comprises a tubular segment or mandrel 11 provided with threaded openings 12 and 13, respectively, at the upper and lower ends thereof. Openings 12 and 13 communicate into a central cavity 14, each opening being conformed for threaded engagement with the ends of a tubing string TS suspended into a well bore WB. In this manner assembly 10 may form a part of a cleaning complement sent down the well bore, including wash assemblies, seals, and the like.

To effect mechanical cleaning contact with the surfaces of the casing CS lining the well bore mandrel 11 is provided with a plurality of longitudinal slots 21 formed in the peripheral surface, each slot being defined by a bottom surface 22 and an upper and lower edge 23 and 24. Slots 21 are distributed at substantially equal arc increments, in a peripheral strip around the mandrel, each slot aligned along a radius in common longitudinal placement between the mandrel ends. Thus, a radial strip of the mandrel is provided with shaped recesses or slots into which replaceable knife carriers may be inserted.

Each knife carrier, generally designated by the numeral 30, includes a rectangular base piece 31 dimensioned for receipt in one of the slots 21 and including a longitudinal bore 32 adjacent its base surface 33. At the opposite surface 34 piece 31 is enlarged to form a pivot carrier 35 extending between an upper and lower shouldered cut out 36 and 37. In this form each base piece 31 is receivable in a corresponding slot 21, exposing the pivot carrier 35 to the exterior. A leaf spring 39, captured between the base surface 33 and the slot bottom 22, urges each base piece outwardly against an upper and lower retainer ring, or collar, 41 and 42 seated respectively in the cutouts 36 and 37. Consequently, each knife carrier 30 is free in radial displacement, to the extent of the flexure of the leaf springs 39, allowing for some local offset in the axis of the well casing.

A longitudinal opening 45 extends through the pivot carrier 35 into bore 32 in which a knife blade 50 is received. A pivot pin 51 then engages the blade 50 to the pivot carrier, fixing the blade for pivotal motion. On the inner side of this pivot the blade extends a projection 52 into bore 32 between the adjacent ends of two, opposed, helical springs 53 and 54 which at their distal ends are compressed by threaded plugs 55. In this form each knife carrier 30 aligns, by spring bias, its blade radially from the mandrel, with further radial motion provided in the flexure of the leaf spring 39. These two modes of spring bias are particularly useful in achieving alignment with perforations P in the well casing, and when fluid at pressure is passed through the mandrel and the tubing string tied thereto, further mechanical excitation is obtained to dislodge or fracture any debris accumulated. All these advantages are obtained in a simple structure which is easily replaced or repaired in the field.

Obviously many modifications and changes are made to the foregoing without departing from the spirit of the invention. It is therefore intended that the scope of the invention should be determined solely on the claims appended hereto.

What is claimed is:

1. A well casing cleaning assembly conformed for attachment to a tubing string, comprising:

a tubular mandrel provided with an upper and lower threaded fitting for engagement to said tubing string, said mandrel including a plurality of longitudinal recesses formed on the exterior thereof, each said recess including an inner base wall;

a plurality of elongate blocks, each conformed for receipt in a corresponding one of said recesses and each including a longitudinal bore, said block each further including a pivotal blade having one portion thereof extending into said bore and first spring means received in said bore for engaging said one portion;

second spring means received in each said recess in opposing alignment relative the corresponding one of said blocks; and retaining means for retaining said blocks in said recesses.

2. Apparatus according to claim 1 further comprising:

said blocks each including exterior cutouts; and said retaining means including collars conformed to engage said cutouts and said mandrel.

3. Apparatus according to claim 2 wherein:

said first spring means urges said blades for orthogonal alignment relative said blocks.

4. Apparatus according to claim 1 wherein:

said second spring means includes a leaf spring interposed between said inner wall of each said recess and said blocks.

* * * * *